US006375259B1

(12) United States Patent
Ma

(10) Patent No.: US 6,375,259 B1
(45) Date of Patent: Apr. 23, 2002

(54) FOLDAWAY PANEL DISPLAY ON A CHAIR

(76) Inventor: Hsi Kuang Ma, 4F, No. 48, Sec. 2, Chung Cherng Road, Taipei (TW)

( * ) Notice: Subject to any disclaimer, the term of this patent is extended or adjusted under 35 U.S.C. 154(b) by 0 days.

(21) Appl. No.: 09/564,638

(22) Filed: May 3, 2000

(51) Int. Cl.[7] ..... A47C 7/72; A47C 31/00

(52) U.S. Cl. ..... 297/217.3; 297/188.01; 297/154; 297/170; 297/173; 297/174

(58) Field of Search ..... 297/217.3, 154, 297/160, 161, 162, 170, 173, 174, 188.01, 188.04, 188.06

(56) References Cited

U.S. PATENT DOCUMENTS

| | | | | | |
|---|---|---|---|---|---|
| 289,384 | A | * | 12/1883 | Brykit | 297/170 X |
| 541,940 | A | * | 7/1895 | Mayes | 297/170 |
| 564,044 | A | * | 7/1896 | Berkemeyer | 297/170 |
| 585,714 | A | * | 7/1897 | Spaet | 297/170 X |
| 675,186 | A | * | 5/1901 | Bacon | 297/170 |
| 689,758 | A | * | 12/1901 | Shaw | 297/170 X |
| 1,211,527 | A | * | 1/1917 | Berndt | 297/170 X |
| 1,799,866 | A | * | 4/1931 | Roth | 297/217.3 X |
| 2,375,696 | A | * | 5/1945 | Shick | 297/188.01 X |
| 2,954,955 | A | * | 10/1960 | Feller | 297/170 X |
| 2,994,366 | A | * | 8/1961 | Hoch | 297/162 X |
| 3,717,375 | A | * | 2/1973 | Slobodan | 297/154 X |
| 5,161,766 | A | * | 11/1992 | Arima | 297/174 X |
| 5,177,616 | A | * | 1/1993 | Riday | 297/217.3 X |
| 5,275,465 | A | * | 1/1994 | Gulliver et al. | 297/173 |
| 5,570,944 | A | * | 11/1996 | Seder et al. | 353/98 |
| 5,653,499 | A | * | 8/1997 | Goodall | 297/170 |
| 5,765,911 | A | * | 6/1998 | Sorenson | 297/161 X |
| 5,893,607 | A | * | 4/1999 | Trimnell | 297/170 |

* cited by examiner

*Primary Examiner*—Peter M. Cuomo
*Assistant Examiner*—Rodney B. White
(74) *Attorney, Agent, or Firm*—Troxell Law Office PLLC

(57) ABSTRACT

A foldaway panel device on a chair comprises a stand lever, chair pivot device, display pivot device, and a panel display. The stand lever is an elongated tube and the chair pivot device pivotally engages with an end of the elongated tube. The display pivot device is sleeved into the other end of the elongated tube, and the panel display has a flat screen with engaging plates extending outward to engage with the display pivot device. The chair pivot device is fixedly attached to a chair such that the panel display can be moved with respect to the chair pivot device, adjusted to any orientation and any angular position, and folded at a storage position in front of a lower part of the chair.

3 Claims, 2 Drawing Sheets

FOLDAWAY PANEL DISPLAY ON A CHAIR

BACKGROUND OF THE INVENTION

1. Field of the Invention

The present invention relates to a foldaway panel display on a chair, and particularly to a device of panel display, which is extended out easily while using the panel display and it is convenient to be folded while the panel display is not in use.

2. Description of Related Art

The panel display is widely used on an electronic product such as computer, television, VCD, DVD, etc. as an output device of videos.

The panel display has been kept to improve the function thereof since it was developed. According to the application of the panel display nowadays, it is not necessary to place the panel display beside a main frame as an output device any more. That is, the panel display can be placed away from the main frame, for instance, a television, and a monitor used in a satellite voyage guide system are arranged in this way.

Moreover, the panel display is getting popular in our daily life. Because it is not required for the panel display to be mounted at a specific location, it is much convenient for us to use the panel display at various places as desired.

In addition to the handiness while using the panel display, whether it is possible to be folded for storage or not is another factor has to be considered. Especially, more periphery devices are used, narrower active area becomes under a limited living space. A foldaway type of panel display is a subject worth us to think of and to pay attention to.

Based on the activities of our daily life and habitual customs, usually we spend one third of time in a day to sleep on a bed and probably spend most rest of the time sitting on a chair. Of course, the so-called chair includes the chair at home, in a classroom, in a car, or in an airplane, and etc. Thus, if the panel display can be attached to a chair, the handiness can be enhanced greatly.

SUMMARY OF THE INVENTION

An object of the present invention is to provide a foldaway panel display on a chair, with which the display is easy to be extended out while in use and it is convenient to be folded while not in use.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1:
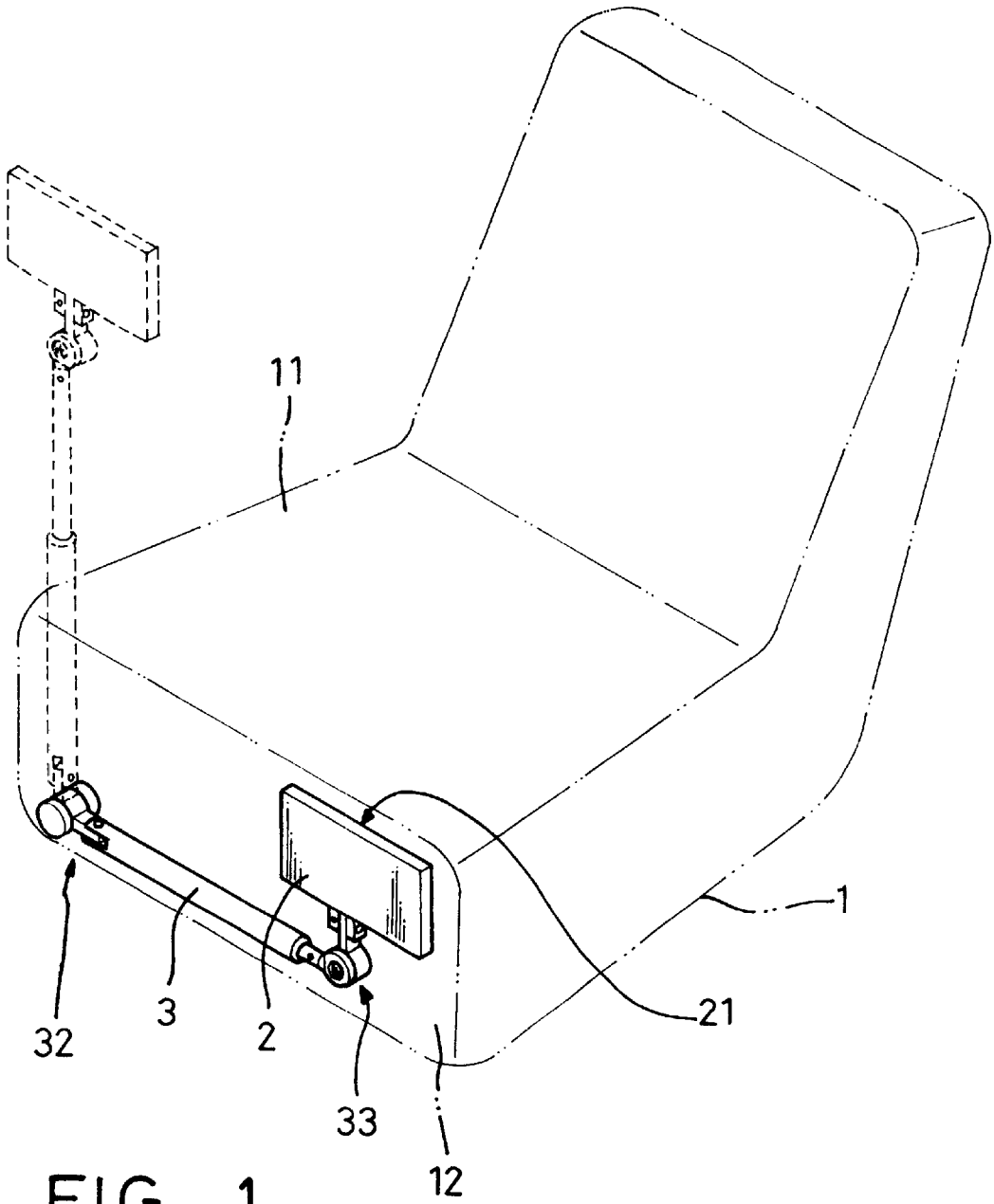
FIG. 1 is a perspective view of a foldaway display on a chair of the present invention.
Figure 3:
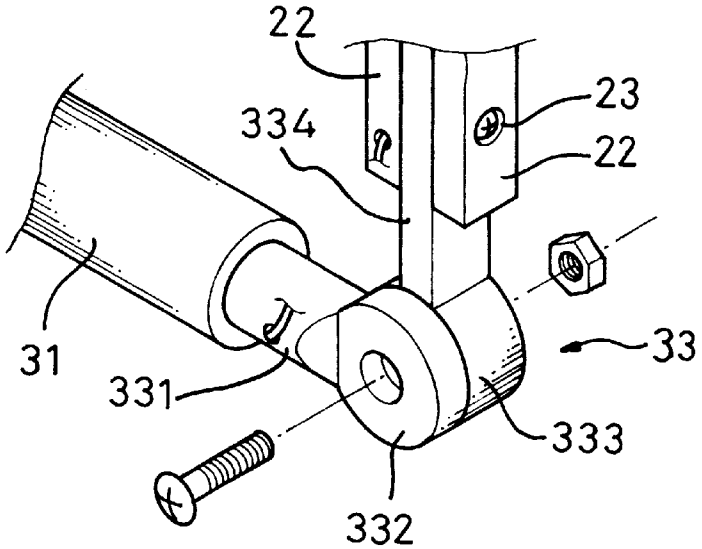
FIG. 3 is another fragmentary perspective view of a stand lever in FIG. 1 illustrating a display engaging with the stand rod.

Referring to FIG. 1, a panel display 2 and a stand lever 3 are associated with each other and attached to chair 1 (shown by broken lines).

The chair 1 is conventional and has a seat part 11. The seat part 11 is provided with a front edge 12 and the front edge

12 may be solid and integral with the seat part 11 or may be a separate plate or framework depending on how the chair is designed. The chair is not the subject of the present invention and there is no further detail will be described hereinafter.

The panel display 2 is a prior art and has a flat screen 21 to display pictures in case of the circuit therein being connected to a main frame. The flat screen 21 at the lower part thereof extends out two parallel locating plates 22 for engaging with the stand lever 3. In order to pivot with respect to the stand lever 3 relatively, the locating plates 22 are provided with an engaging hole 23 respectively. In practice, a single locating plate 22 may be used instead of two locating plates 22 so as to be disposed between engaging plates extending outward of the stand lever 3. The engaging plates on the stand lever 3 are prior art and no further detail will be described either.

The stand lever 3 is elongated and the middle part thereof is an elongated tube 31 and the elongated tube 31 may be a single tube or a telescopic tube as the prior art does. The stand lever 3 at an end thereof is a chair pivot device 32 to engage with the chair 1 and at the other end thereof is a display pivot device 33 to engage with the display 2.

Figure 2:
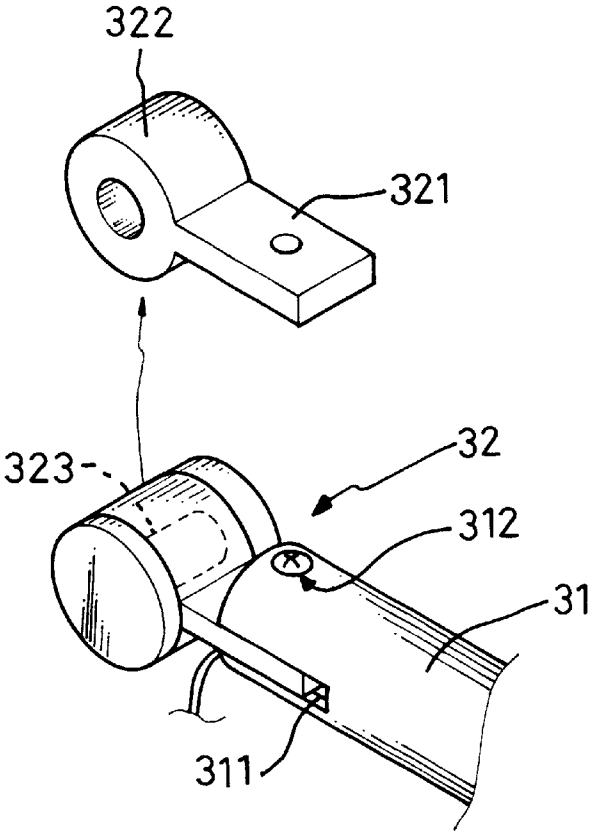
FIG. 2 is a fragmentary perspective view of a stand rod in FIG. 1 illustrating a chair engaging with the stand lever.

As shown in FIG. 2, the chair pivot device 32 has a fitting plate 321 with a through hole to be associated with the elongated tube 31 and a fitting ring 322 extending outward with a threaded hole to be fitted with a threaded pivot 323. The elongated tube 31 at an end thereof is provided with a split 311 to be inserted by the fitting plate 321 and a threaded hole 312 perpendicular to the split 311 to be passed through by a screw so as to fasten the fitting plate 321. Hence, the stand lever 3 can be moved pivotally with respect to the pivot 323 after the chair pivot device 32 being mounted at the front edge 12 on the chair 1.

The display pivot device 33 has a core tube section 331 to sleeve in the elongated tube 31 at the other end thereof so as to rotate or extend with respect to the elongated tube 31. The tube section 331 extends outward an end plate 332 with a through hole and a locating ring 333 is disposed beside the end plate 332. The locating ring 333 further extends out an engaging slat 334 to be sandwiched by the locating plates 22 so as to be fastened by screws. Hence, the panel display 2 can be pivotally moved with respect to the stand lever 3 after the display pivot device 33 being mounted.

Referring to FIG. 1 again, in practice, the chair pivot device 32 is fixedly attached to the front edge 12 at the lower left or the lower right thereof on the chair. The display pivot device 33 is pivotally engages with the stand lever 3.

In operation, the stand lever 3 with the panel display 2 is pivotally moved to an upright position with respect to the chair pivot device 32 and then the elongated tube 31 and the tube section 331 can be extended axially to adjust the height of the panel display 2. Furthermore, an angular position of the panel display 2 can be adjusted with respect to the display pivot device 33 and another angular position of the panel display 2 can be adjusted by way of turning the tube section 331 with respect to the elongated tube 31.

When the foldaway panel display is not in use, the elongated tube 31 can be folded and the panel display 2 can be located at the lower part of the front edge 12 in a state of storage. In this way, a space impediment to interfere any movement of the user can be avoided completely.

The current leads of circuit can be arranged to enter the elongated tube 31 via the chair pivot device 32 and then to connect with the panel display 2. Because the current lead connection is prior art, no further explanation will be described in detail.

While the invention has been described with reference to a preferred embodiment thereof, it is to be understood that modifications or variations may be easily made without departing from the spirit of this invention, which is defined by the appended claims.

What is claimed is:

1. A foldaway panel device for a chair comprising:

a stand lever, comprising an elongated tube with two ends;

a chair pivot device configured to be attached to a chair and pivotally engaging a first of the two ends of the elongated tube;

a display pivot device sleeved into a second of the two ends of the elongated tube; and a panel display, having a flat screen, and having engaging plates extending outwardly to engage the display pivot device;

whereby, the panel display can be moved with respect to the chair pivot device, adjusted to any orientation and any angular position, and folded at a storage position, wherein the chair pivot device has a fitting plate with a through hole thereon associated with the elongated tube and a fitting ring extending outwardly with a threaded hole being fitted with a threaded pivot; and the elongated tube at an end thereof is provided with a split inserted by the fitting plate and a threaded hole perpendicular to the split being passed through by a screw so as to fasten the fitting plate.

2. A foldaway panel device for a chair comprising:

a stand lever, comprising an elongated tube with two ends;

a chair pivot device configured to be attached to a chair and a first of the two ends of the elongated tube;

a display pivot device sleeved into a second of the two ends of the elongated tube; and a panel display, having a flat screen, and having engaging plates extending outwardly to engage the display pivot device;

whereby, the panel display can be moved with respect to the chair pivot device, adjusted to any orientation and any angular position, and folded at a storage position, wherein the display pivot device has a core tube section sleeved in the elongated tube at the second end thereof; the tube section extends outwardly having an end plate with a through hole and a locating ring disposed beside the end plate; and the locating ring further extends out an engaging slat and is sandwiched by locating plates so as to be fastened with each other.

3. The foldaway panel device according to claim 2, wherein the tube section on the display pivot device can be turned with respect to the elongated tube.

* * * * *